US009435039B2

(12) United States Patent
O'Keefe et al.

(10) Patent No.: US 9,435,039 B2
(45) Date of Patent: Sep. 6, 2016

(54) PROTECTIVE CONVERSION COATING ON MIXED-METAL SUBSTRATES AND METHODS THEREOF

(75) Inventors: Matthew J. O'Keefe, Rolla, MO (US); Surender Maddela, Rolla, MO (US)

(73) Assignee: The Curators Of The University Of Missouri, Columbia, MO (US)

( * ) Notice: Subject to any disclaimer, the term of this patent is extended or adjusted under 35 U.S.C. 154(b) by 0 days.

(21) Appl. No.: 13/450,667

(22) Filed: Apr. 19, 2012

(65) Prior Publication Data

US 2012/0205011 A1 Aug. 16, 2012

Related U.S. Application Data

(63) Continuation-in-part of application No. 12/535,939, filed on Aug. 5, 2009, now Pat. No. 8,187,439.

(51) Int. Cl.

| | |
|---|---|
| ***C23C 22/05*** | (2006.01) |
| ***C25D 13/20*** | (2006.01) |
| ***C23G 3/00*** | (2006.01) |
| ***C23C 22/68*** | (2006.01) |
| ***C23G 1/00*** | (2006.01) |
| ***C25D 13/22*** | (2006.01) |

(52) U.S. Cl.

CPC ..... *C23G 3/00* (2013.01); *C23C 22/68* (2013.01); *C23G 1/00* (2013.01); *C25D 13/20* (2013.01); *C25D 13/22* (2013.01)

(58) Field of Classification Search

CPC ..... C23G 3/00; C23C 22/68; C23C 1/00; C25D 13/20; C25D 13/22

USPC ..... 148/245, 254

See application file for complete search history.

(56) References Cited

U.S. PATENT DOCUMENTS

| | | | | |
|---|---|---|---|---|
| 5,773,090 | A * | 6/1998 | Buttner et al. | 427/327 |
| 6,168,868 | B1 | 1/2001 | Hauser et al. | |
| 6,312,812 | B1 * | 11/2001 | Hauser | B05D 7/14 428/412 |
| 6,773,516 | B2 * | 8/2004 | Hardin et al. | 148/243 |
| 6,818,116 | B2 * | 11/2004 | Stoffer et al. | 205/238 |
| 7,241,371 | B2 | 7/2007 | Stoffer et al. | |
| 7,531,074 | B2 | 5/2009 | Purdy et al. | |
| 7,695,771 | B2 | 4/2010 | Ostrovsky | |
| 7,906,002 | B2 | 3/2011 | Shimoda et al. | |
| 2006/0113007 | A1 * | 6/2006 | Morris | C09D 5/086 148/273 |
| 2007/0231579 | A1 * | 10/2007 | Jones | C09D 163/00 428/413 |
| 2008/0145678 | A1 | 6/2008 | McMurdie et al. | |
| 2009/0266714 | A1 | 10/2009 | Kaneko et al. | |

* cited by examiner

*Primary Examiner* — Kishor Mayekar

(74) *Attorney, Agent, or Firm* — Billion & Armitage; Benjamin C. Armitage

(57) ABSTRACT

Mixed-metal automotive vehicle bodies-in-white comprising ferrous metal surfaces, zinc surfaces, aluminum alloy surfaces, and magnesium alloy surfaces are cleaned and immersed in an aqueous bath comprising an adhesion promoter and an aqueous electrocoat bath (the adhesion promoter may be in the electrocoat bath. The adhesion promoter, which may be a cerium salt, is selected to react with each metal in the body surfaces to form an oxide layer that provides corrosion resistance for the surface and adherence for the deposited polymeric paint coating. The body is cathodic in the electrocoat deposition.

18 Claims, 2 Drawing Sheets

PROTECTIVE CONVERSION COATING ON MIXED-METAL SUBSTRATES AND METHODS THEREOF

RELATED APPLICATION

This application is a continuation of U.S. patent application Ser. No. 12/535,939 filed Aug. 5, 2009, which is incorporated herein by reference in its entirety.

GOVERNMENT SUPPORT

This invention was made with government support under grant no. DE-EE0003583 awarded by the Department of Energy. The government has certain rights in the invention.

BACKGROUND OF THE INVENTION

Automotive vehicles may comprise passenger vehicles, trucks, vans, cross-over vehicles and other body variations. The bodies are constructed of load bearing structural members, floor members, closure members and the like. Such body members have been formed of cold rolled steel and galvanized steel and, in more recent years, from aluminum alloys. The respective body members are joined by welding, hemming, clinching, bolting, and like joining practices to form a body structure that is then ready for painting. Such an unpainted vehicle body structure is referred to as a "body-in-white" (sometimes referred to as BIW) because of the appearance of the bare metal elements of the body structure. Such vehicle bodies are then processed through long and sophisticated automotive phosphating and paint lines.

As suggested above, many vehicle bodies-in-white now contain portions that are formed from steel, galvanized steel and various aluminum alloys. A body comprising each of such ferrous, zinc, and aluminum materials is thoroughly cleaned and provided with a phosphate-containing surface conversion coating by immersion in an aqueous bath of phosphating composition. The phosphate conversion coatings chemically formed on the ferrous surfaces include iron (and sometimes zinc) and the phosphate conversion coatings on the aluminum surfaces comprise aluminum, and they are formed as a barrier layer on each exposed surface to provide corrosion resistance. These phosphate-containing conversion coatings have irregular surfaces that provide a tie-in base for a subsequently applied electrocoat paint layer. After phosphating, the vehicle bodies usually receive at least four paint layers to provide additional corrosion protection and color finishes. These paint layers include, in order of application: an electrocoat, a surface primer base coat, a base color coat, and a clear coat.

Now it is desired to make closure panels and other body members using magnesium alloys because of their favorable strength-to-weight ratio and because they can be formed as such body members and attached to complementary body members of magnesium, aluminum, or ferrous-based materials. However, magnesium is very reactive in aqueous solution and subject to galvanic corrosion, especially when coupled with steel alloys or aluminum alloys. When a magnesium body surface is immersed in an aqueous phosphating bath, magnesium dissolves in the bath, contaminates it, and adversely affects the quality of phosphate coating formed on nearby steel or aluminum surfaces.

It is an object of this invention to provide practices for forming conversion coatings and electrocoatings on bodies-in-white that comprise magnesium surfaces and aluminum alloy surfaces and/or steel surfaces, including galvanized steel surfaces.

SUMMARY OF THE INVENTION

This invention provides a method for forming a co-extensive electrocoat paint layer on automotive vehicle bodies-in-white that have magnesium alloy surfaces in combination with one or more of steel surfaces, galvanized steel surfaces, and aluminum alloy surfaces. Such body-in-white constructions that have magnesium alloy surfaces in combination with a different metal surface will sometimes be referred to in this specification as mixed-metal assemblies or mixed-metal BIW assemblies.

An example of a magnesium alloy that may be formed into a body member is AZ91D. AZ91D is a magnesium-based alloy that is available in rolled sheet form for shaping into body panels and the like. Its, nominal composition, by weight, is about 9% aluminum, 1% zinc, and the balance magnesium, except for minor amounts of impurities.

Each such mixed-metal BIW is cleaned through spray clean/dip clean/rinse stages. In a preferred embodiment of the invention, each body is conveyed sequentially through a spray cleaning stage, into a dip or full immersion cleaning stage, and then through a spray rinse stage. The first cleaning stage may be an acid cleaner and the second cleaning stage may be an alkaline cleaner to clean and expose the respective metal composition surfaces for the following process step.

After the cleaning stage, each mixed-metal BIW will receive a conversion coating step and an electrocoat step. In a preferred embodiment of the invention these two steps may by combined by immersing the mixed metal body in an aqueous bath of adhesion promoting material composition and electrocoat composition. Upon immersion, the mixed metal body is connected as the cathode in the electrocoating tank. The adhesion promoting material is suitably a composition (for example, cerium trichloride) that will react with magnesium body surfaces and surfaces of the other metal body members upon immersion of the body in the aqueous bath material of the tank. In a preferred embodiment, this mixed-metal body electrocoat process includes adhesion promoter additives in an epoxy-based electrocoat aqueous solution and an applied voltage between −100 to −300V, with the car body being the cathode. Thus, the mixed-metal BIW is cathodically protected and the dissolution of magnesium is mitigated. As the hydrogen gas is evolved from the cathodically charged body, the interface pH increases to cause co-deposition of polymer and adhesion promoter oxides (e.g. cerium, zirconium, vanadium, titanium or silicon-based compounds, etc). Some of the cerium salt (or other adhesion promoter) reacts with the respective metal surfaces to form cerium-containing conversion layers. At the same time, micelles of polymer composition (epoxy in this example) from the bath migrate to the cathodic surface and form a continuous polymer coating over the metal surfaces with their thin conversion layers. The bath composition often contains pigment particles of titanium dioxide, or the like, which become incorporated into the deposited protective coating layer.

The exposure of the mixed metal body-in-white to the adhesion promoter and electrocoating process is about one to three minutes (consistent with painting line speed) with the bath at substantially ambient temperature. As the body is lifted from the bath the respective metal portions each carry a thin conversion coating, 50-500 nanometers thick, which in turn is coated with a more or less fixed polymeric electrocoat layer of thickness 20 to 40 micrometers. And conversion material may be entrained in the newly deposited electrocoat layer from where it can migrate to the underlying metal-conversion coat surface. The polymer layer is suitably fixed to be rinsed with water to remove loosely adsorbed bath material.

The electrocoated mixed-metal body is rinsed with deionized water or the like to remove adherent bath material. After removal of extraneous water the electrocoated mixed metal body is conveyed through a paint bake oven to finish polymerization of the electrocoat material.

After baking, this electrocoat will display adhesion and corrosion protection performance comparable to the phosphate/electrocoat combined coatings obtained in vehicle body lines that did not have magnesium-based body surfaces.

Other objects and advantages of the invention will be apparent from a detailed description of preferred embodiments of the invention which follows in this specification.

DESCRIPTION OF PREFERRED EMBODIMENTS

Figure 1:
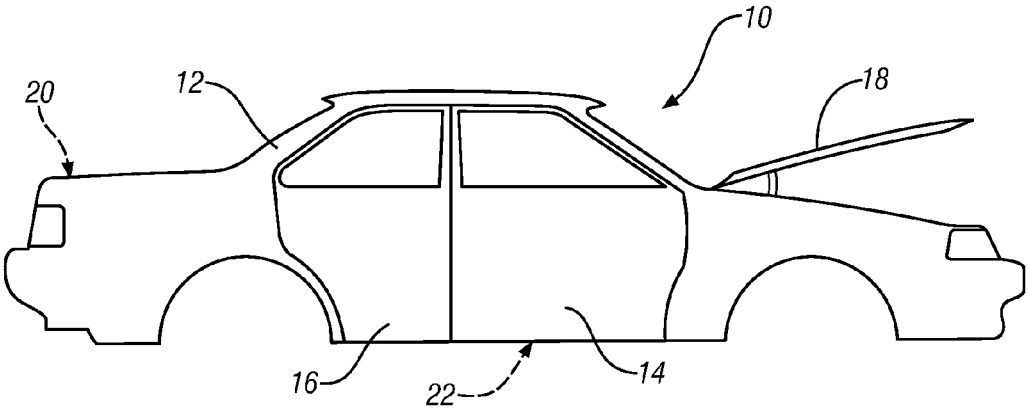
FIG. 1 is a side view of an illustrative mixed metal body-in-white.

FIG. 1 illustrates a multi-metal automobile body-in-white structure 10 that includes magnesium parts as well as steel and/or aluminum alloy parts. Here, the body structure 10 includes a frame 12, a front door assembly 14, a rear door assembly 16, an engine compartment hood 18, and a deck lid (not visible, but indicated at location 20), and a floor pan (not visible, but indicated at location 22). Each of these portions of the body-in-white structure may be formed using one of cold rolled steel, galvanized steel, an aluminum alloy, or a magnesium alloy. In accordance with practices of this invention the mixed-metal body-in-white comprises at least one body member that is fabricated or formed using a magnesium alloy starting material or shape. For example, a front door assembly 14 of inner and outer sheet metal panels (one on each side of body 10) may comprise at least one panel that is formed of a magnesium alloy.

A first example of a suitable magnesium alloy that may used in door assembly 14 (or other body member) is magnesium alloy AZ31, which has a nominal composition, by weight, of about 3% aluminum, about 1% zinc, about 0.2% manganese, and the balance magnesium. A second example of a magnesium alloy that may be used in making a body-in-white is AZ91D, identified above in this specification.

It should be understood that FIG. 1 represents a simplified illustration of a rather complex body-in-white structure that contains many different interacting parts attached through a variety of means. And as such there are many other parts—both larger and smaller than the door assembly 14—that could feasibly be constructed fully or partly from magnesium even though they are not specifically shown or described here. It follows that the magnesium surfaces of those parts will behave similarly to the magnesium surfaces of the door assembly 14 of this illustration.

In the manufacture of automotive vehicles, like or different metal bodies-in white are continuously constructed according to production schedules. Currently, these bodies are fabricated using steel, galvanized steel, and one or more aluminum alloys. A generally continuous stream of these ferrous and aluminum bodies is then conveyed though a painting line in which each just-made body-in-white is carefully cleaned by spray and immersion processes, provided with phosphate-containing conversion coatings on the respective metal surfaces, and then provided with an electrocoat of paint. Additional painting and vehicle assembly steps follow on a more-or-less continuous basis.

This invention provides a method for including magnesium parts and surfaces in the body-in-white which do not tolerate phosphating and, indeed, damage a phosphating bath to the detriment of adjoining non-magnesium surfaces on the BIW.

In accordance with this invention, magnesium-containing, mixed-metal bodies-in-white are provided with a protective conversion coating (such as a cerium-containing conversion coating) and electrocoated as a cathode at a suitable negative voltage in a suitable aqueous electrocoat composition bath.

Figure 2:
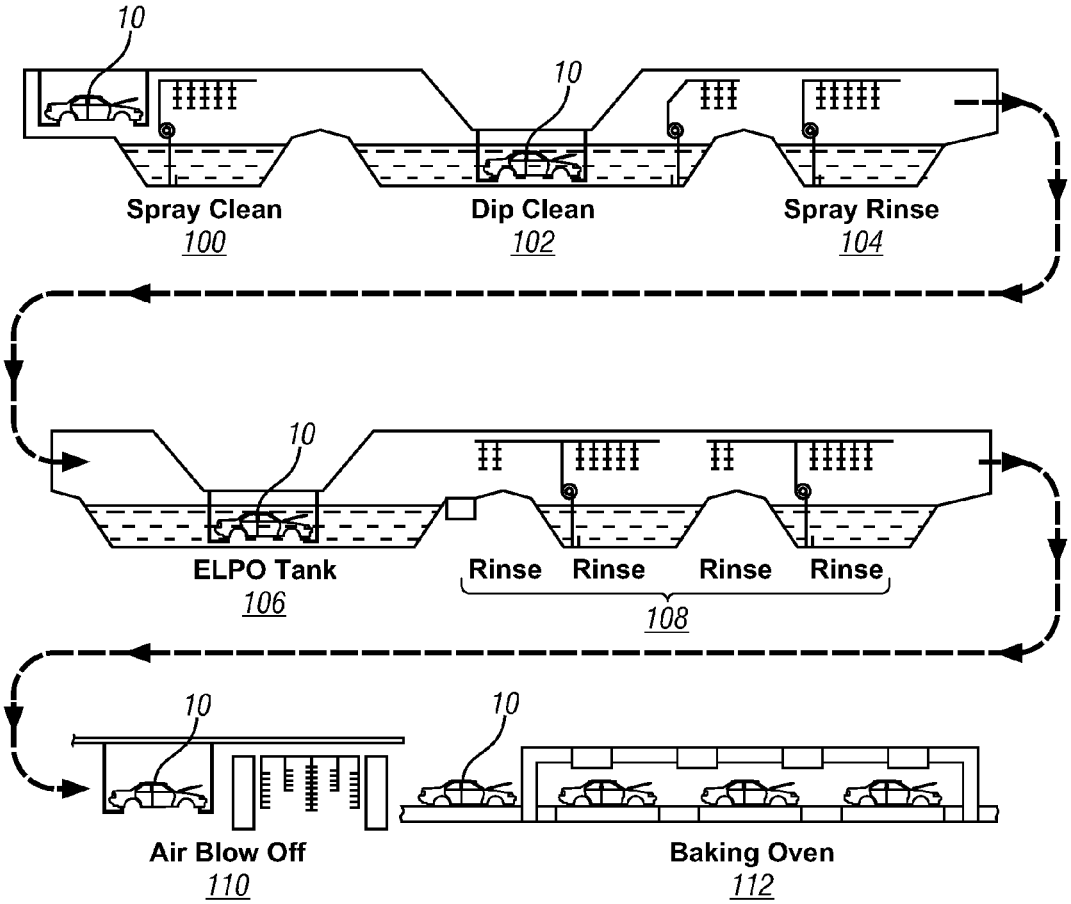
FIG. 2 is a schematic illustration of the transport of a mixed metal body-in-white through a representative vehicle body processing line of cleaning stages, electrocoat painting and conversion coating stage, rinsing stages, and a paint bake over stage.

FIG. 2 illustrates one embodiment of a sequence of processing steps by which a continuous succession of like or varying vehicle bodies-in-white (such as body-in-white 10 illustrated in FIG. 1) are carried by a conveyer system through conversion coating and electrocoating steps suitable for multi-metal bodies having magnesium-based surfaces.

As illustrated schematically in FIG. 2, a BIW 10 is suspended, front and rear, and carried through a spray cleaning stage 100 in which an aqueous acid cleaner composition is pumped from a bath in an underlying tank and vigorously sprayed over all surfaces of the mixed-metal body in white 10. The conveyer line may pause for a minute or so (according to paint line speed) as the aqueous cleaner is sprayed on all external and external surfaces of the body. An example of a suitable acid cleaner is an aqueous solution of sulfuric acid containing about 1 percent by weight of sulfuric acid. The aqueous acidic cleaner drains from the body 10 as it is then conveyed to a tank of aqueous alkaline cleaner 102.

In this embodiment, the body-in-white 10 is immersed in the aqueous alkaline cleaner bath contained in the tank. An example of a suitable alkaline cleaner is an aqueous solution of sodium carbonate containing about 5 percent by weight of sodium carbonate. Again, the line pauses as multi-metal body-in-white 10 is immersed in alkaline cleaner 102. The order and means of application of aqueous acid cleaning and alkaline cleaning is a matter of choice. The body 10 is raised from the alkaline cleaner bath and drains as the body is conveyed through an aqueous spray rinse station 104. For simplicity of illustration, a body 10 is not necessarily illustrated at each stage of the in-line process.

Figure 3:
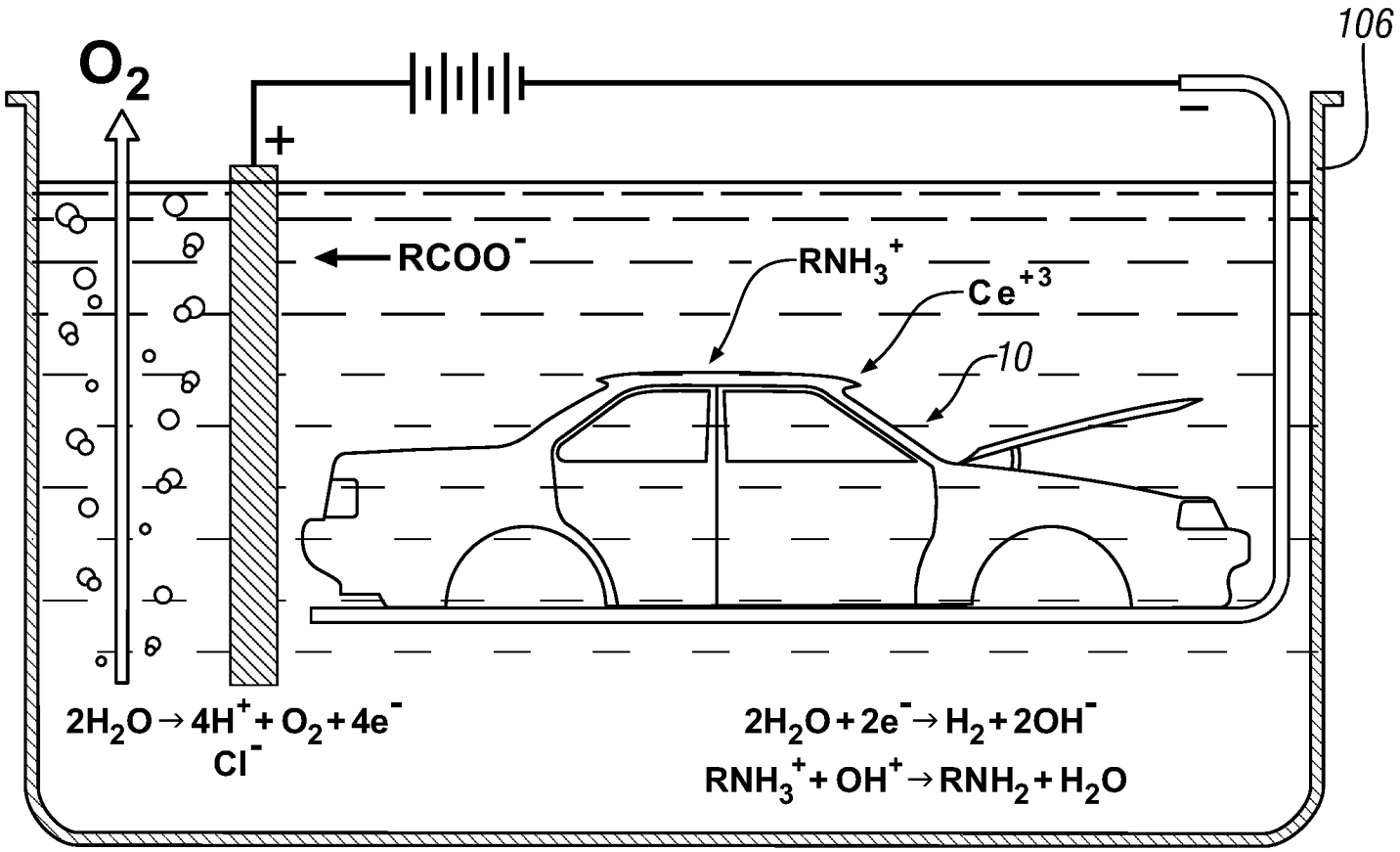
FIG. 3 is a schematic view in cross-section illustrating electrode reactions and other transport processes with a body-in-white immersed in an electrocoating tank in which an adhesion promoter is used in treating a mixed metal body-in-white in accordance with this invention.

The cleaned and rinsed body-in-white is now ready for immersion in a combined conversion coat and electrocoat bath 106 (also designated as ELPO tank). A larger schematic view of a body-in-white 10 fully immersed in an aqueous conversion coating and electrocoating bath 106 is illustrated in FIG. 3. The vehicle body 10 is connected as a cathode in bath 106 and one or more anodes are provided. Means, schematically illustrated, are provided to impose an electrical potential of about −100 volts to about −300 volts on body-in-white 10. In accordance with a preferred embodiment of the invention, aqueous bath 106 comprises a suitable cathodic electrocoat resin composition and a dissolved adhesion promoting composition that acts by reacting with each of the different metal surface materials to form a conversion coating on each of their surfaces.

The conversion coating composition is a dissolved oxidizing composition comprising cations capable of forming a conversion coating with each of the metal surfaces of the body. The resulting conversion coating comprises elements of the cations and oxygen, and often of the underlying metal alloy. The cations of the composition react with each of the mixed-metal surfaces upon immersion of the body 10 in the bath 106. Examples of suitable dissolved oxidizing compositions include one or more of compounds selected from the group consisting of cerium-based compounds, silicon-based compounds, titanium-based compounds, vanadium-based compounds, and zirconium-based compounds. Such conversion coating materials are often used in amounts of about five to about twenty grams per liter of the aqueous bath. Cerium trichloride salt is an example of a preferred conversion coating material. In this example, cerium ions (+3) react with each of the ferrous surfaces, zinc surfaces, aluminum surfaces and magnesium surfaces to form cerium-containing and oxygen-containing layers on the respective metal surfaces. These conversion coatings may also contain elements from the metal surfaces and form thin cratered and irregularly shaped coating layers to which the depositing electrocoat layer adheres. The resulting conversion coatings on the respective metal surfaces are suitably electrically conductive for electrochemical deposition of the electrocoat polymer.

Cathodic electrocoat deposition of water-dispersed organic coatings has gained worldwide acceptance, especially by the automotive industry, because of its numerous benefits, e.g., ability to coat recessed areas, uniform coating thickness, almost complete paint utilization, and reduction of environmental pollution. In the practice of this invention such cathodic coating materials are used in combination with the above-described conversion coating materials to form (preferably in one step or bath; suitably in two steps or successive baths) a combination of conversion coating and electrocoat to a combined thickness of about ten to forty micrometers on the surfaces of each of the multi-metal areas of the immersed body-in-white.

A representative and suitable cathodic electrocoat bath, e.g., DuPont Electroshield™ 21 gray bath comprises 71-82 wt % water, epoxy resin 16-26 wt %, and titanium dioxide 1.3 wt %. The electrocoat emulsion may be prepared and continually replenished using a mixture of a resin feed package and a pigment feed package. In this formulation, the resin feed package include a cathodic electrocoat or electroprimer that is partially neutralized with a weak organic acid ($R_a$—H), such as acetic acid, and then emulsified in water. The resin package used here is typically composed of an aminoepoxy resin (R—$NH_2$) mixed with a blocked isocyanate cross-linker. In the aqueous bath the resin emulsion stabilizes to contain water soluble polymer coating micelles or particles (R—$NH_3$), as shown by the reaction: $RNH_2+Ra—H \rightarrow RNH_3^{+}+R_a^{-}$. In this embodiment of the invention, the bath also comprises 1.0 wt % (about 10 grams per liter of bath) of cerium chloride for formation of the conversion coating on the mixed-metal body-in-white 10.

The mechanism of the cathodic deposition process includes: 1) hydroxide production at the cathode side and an increase in the local pH value of the paint solution; 2) migration of charged micelles to the cathode; 3) discharge and coagulation of the micelles due to local pH increase and 4) elimination of water from the deposited paint by electroosmosis. As indicated in FIG. 3, cerium ions ($Ce^{+3}$) react with the metal surfaces of body 10 to form a conversion coating on the metal surfaces. Under the applied potential of −100 volts to −300 volts, hydrogen is evolved at the cathodic body with the production of hydroxide. Resin micelles react with hydroxide ions at the cathodic body 10 and resin (and titanium oxide pigment particles) is deposited on the conversion coating. Oxygen and hydrogen ions are released at the anode. Cerium ions may also be entrained in the deposited polymer coating and can migrate to the coated metal surface for further reaction with the metal elements.

As an example, each body-in-white 10 may be immersed in a bath 106 for a period of two to three minutes to obtain a suitable conversion coating and electrocoat. Indeed, the speed of this paint line may be based on the operation of this coating bath 106.

Body-in-white 10 with its cerium-induced conversion coating and wet, un-cured epoxy-based electrocoat is removed from bath 106 and conveyed through a series of rinses with water and de-ionized water (stage 108 in FIG. 2). A combination of spray rinses and immersion rinses may be used. The rinsed body is then carried to an air blow-off stage 110 to remove superficial water, and then conveyed through a baking oven 112 to complete the polymerization of the electrocoat resin. Following paint baking, the electrocoated and conversion coated body is further painted and subjected to assembly operations for vehicle manufacture.

In the above illustrative embodiment, the mixed-metal body-in-white was contacted with the conversion coating material and electrocoat material in a common aqueous bath 106 (in FIG. 3). However, in another embodiment of the invention, the conversion coating may be formed in a first bath and an electrocoating may be formed in a second bath. This two-step practice may be preferred to make use of different bath chemistries and operating parameters.

A mixed-metal body-in-white formed of a magnesium alloy surface and at least one of a ferrous metal surface, a zinc-coated ferrous metal surface, and an aluminum alloy metal surface is provided with a conversion coating and an electrocoat. The conversion coating is formed preferably on each of the differing metal surfaces making up the surfaces of the vehicle body. The conversion coating is formed in an aqueous bath containing dissolved cations of at least one oxidizing material. The electrocoat is deposited on each of the metal surfaces of the vehicle body over the conversion coatings and may contain some of the cations of oxidizing material.

While practices of the invention have been described in terms of some illustrative examples, it is clear that other reactive material and practices may be used that are within the scope of the invention.

The invention claimed is:

1. A method of forming a protective conversion coating on a mixed-metal substrate, the method comprising:

contacting a cerium salt and an oxidizing agent, sufficient to form a protective conversion coating solution;

providing a mixed-metal substrate having a plurality of joined metal surfaces, at least one of the surfaces comprising magnesium, and at least one of the surfaces comprising ferrous metal, zinc, or aluminum; and depositing the protective conversion coating solution on each metal surface of the mixed-metal substrate to form a protective metal coating conversion solution layer, and wherein any metal present is selected from the group consisting of cerium and one or more metals of the mixed-metal substrate.

2. The method of claim 1, wherein the oxidizing agent comprises a peroxide compound.

3. The method of claim 1, wherein the oxidizing agent comprises hydrogen peroxide.

4. The method of claim 1, wherein depositing comprises spraying.

5. The method of claim 1, further comprising rinsing the substrate after forming the protective coating.

6. The method of claim 1, further comprising contacting the protective metal coating conversion solution layer with a phosphate-containing solution.

7. A method of forming a protective conversion coating on a mixed-metal substrate, the method comprising:

providing a mixed-metal substrate having a plurality of joined metal surfaces, at least one surface comprising magnesium, and at least one of the surfaces comprising ferrous metal, zinc, or aluminum;

immersing the mixed-metal substrate in an aqueous bath including a dissolved oxidizing composition comprising metal cations capable of forming a conversion coating with each metal surface of the mixed-metal substrate; wherein the metal cations are selected from a group consisting of cerium cations, the conversion coating includes cerium and oxygen, and the metal cations react with each of the metal surfaces of the mixed-metal substrate upon immersion to form a conversion coating on each metal surface of the mixed-metal substrate.

8. The method of claim 7, wherein the dissolved oxidizing composition comprises at least one of the compounds selected from the group consisting of cerium-based compounds, silicon-based compounds, titanium-based compounds, vanadium-based compounds, and zirconium-based compounds.

9. The method of claim 7, wherein the oxidizing composition comprises a cerium-based compound.

10. The method of claim 7, wherein the oxidizing composition comprises cerium trichloride.

11. The method of claim 7, wherein the thicknesses of the conversion coating is up to about 500 nanometers.

12. The method of claim 7, further comprising sequentially cleaning the surfaces of the substrate with one of an alkaline cleaner and an acid cleaner, and then with the other cleaner, before the substrate is immersed in a bath comprising a dissolved oxidizing solution.

13. The method of claim 7, further comprising contacting the conversion coating with a phosphate-containing solution.

14. A method of forming a protective conversion coating on a mixed-metal substrate, the method comprising:

providing a mixed-metal substrate having a plurality of joined metal surfaces including a first surface comprising magnesium, and a second metal surface different from the first surface; and immersing the mixed-metal substrate in an aqueous bath including a dissolved oxidizing composition comprising cerium cations capable of forming a conversion coating with each metal surface of the mixed-metal substrate, wherein the conversion coating includes cerium and oxygen, and the cerium cations react with each of the metal surfaces of the mixed-metal substrate upon immersion to form a conversion coating on the surface of each metal of the mixed-metal substrate.

15. The method of claim 14, further comprising contacting the conversion coating with a phosphate-containing solution.

16. A method of forming a protective conversion coating on a mixed-metal substrate, the method comprising:

contacting a cerium salt and an oxidizing agent, sufficient to form a protective conversion coating solution;

providing a mixed-metal substrate having a plurality of joined metal surfaces including a first surface comprising magnesium, and a second metal surface different from the first surface; and depositing the protective conversion coating solution on each metal surface of the mixed-metal substrate to form a protective coating conversion solution layer; wherein the conversion coating solution comprises an accelerator selected from the group consisting of a peroxide compounds.

17. The method of claim 16, wherein the peroxide compound comprises hydrogen peroxide.

18. The method of claim 16, further comprising contacting the protective coating conversion solution layer with a phosphate-containing solution.

* * * * *